US011271277B2

(12) United States Patent
Zhang et al.

(10) Patent No.: US 11,271,277 B2
(45) Date of Patent: Mar. 8, 2022

(54) DIELECTRIC WAVEGUIDE FILTER

(71) Applicants: SHENZHEN GRENTECH RF COMMUNICATION LIMITED, Guangdong (CN); NANNING GRENTECH RF COMMUNICATION LIMITED, Guangxi (CN)

(72) Inventors: Bo Zhang, Guangdong (CN); Jianwang Wu, Guangdong (CN); Zongjin Duan, Guangdong (CN)

(73) Assignees: Shenzhen Grentech RF Communication Limited, Shenzhen (CN); Nanning Grentech RF Communication Limited, Nanning (CN)

( * ) Notice: Subject to any disclaimer, the term of this patent is extended or adjusted under 35 U.S.C. 154(b) by 0 days.

(21) Appl. No.: 17/437,691

(22) PCT Filed: Nov. 1, 2019

(86) PCT No.: PCT/CN2019/115070
§ 371 (c)(1),
(2) Date: Sep. 9, 2021

(87) PCT Pub. No.: WO2021/012447
PCT Pub. Date: Jan. 28, 2021

(65) Prior Publication Data

US 2022/0045411 A1 Feb. 10, 2022

(30) Foreign Application Priority Data

Jul. 19, 2019 (CN) ..... 201910656198.1

(51) Int. Cl.
*H01P 1/20* (2006.01)
*H01P 3/16* (2006.01)

(52) U.S. Cl.
CPC ..... *H01P 1/2002* (2013.01); *H01P 3/16* (2013.01)

(58) Field of Classification Search
CPC ..... H01P 1/2002; H01P 1/202; H01P 1/2053; H01P 1/2056; H01P 1/20; H01P 1/201; H01P 1/207; H01P 1/208; H01P 1/2084; H01P 1/2086; H01P 1/2088; H01P 1/205; H01P 3/16; H01P 3/122; H01P 3/112;
(Continued)

(56) References Cited

FOREIGN PATENT DOCUMENTS

| | | | |
|---|---|---|---|
| CN | 108598635 | A | 9/2018 |
| CN | 109309272 | A | 2/2019 |
| CN | 110011018 | A | 7/2019 |

(Continued)

*Primary Examiner* — Stephen E. Jones
(74) *Attorney, Agent, or Firm* — Muncy, Geissler, Olds & Lowe, P.C.

(57) ABSTRACT

The present invention relates to a dielectric waveguide filter, comprising a dielectric substrate, wherein the dielectric substrate comprises a plurality of resonators; the plurality of resonators are connected to each other; the dielectric substrate further comprises a negative coupling blind hole; the negative coupling blind hole is arranged at a joint between two adjacent resonators; the two adjacent resonators are respectively provided with a tuning blind hole; and the tuning blind hole of one of the two adjacent resonators is connected to the negative coupling blind hole by a first coupling structure. The present invention can effectively suppress parasitic coupling of the dielectric waveguide filter.

10 Claims, 8 Drawing Sheets

A — A

(58) Field of Classification Search
CPC .... H01P 3/12; H01P 3/121; H01P 7/10; H01P 7/105
See application file for complete search history.

(56) References Cited

FOREIGN PATENT DOCUMENTS

| | | | |
|---|---|---|---|
| CN | 110265754 | A | 9/2019 |
| CN | 110265755 | A | 9/2019 |
| JP | 60165102 | A | 8/1985 |

B — B

DIELECTRIC WAVEGUIDE FILTER

FIELD OF THE INVENTION

The present invention relates to a communication device component, and more particularly, to a dielectric waveguide filter.

BACKGROUND OF THE INVENTION

A filter is a frequency-selecting component, which plays an important role in a radio frequency component. With the advent of 5G era, miniaturization of components is a key to the development of a communication device, and a miniaturized filter with high performance and low power consumption is a key to the miniaturization of a 5G device. Compared with a traditional waveguide filter, a dielectric waveguide filter has great advantages and has become a hot research object in the industry.

Traditional waveguide filter with air filling is improved by dielectric waveguide filter with filling of a ceramic material with a high dielectric constant, and the ceramic dielectric material is formed by die casting, and plays a role of signal transmission and structure support.

Due to increasingly strict requirements of a 5G radio frequency system for out-of-band suppression, it is necessary to add a transmission zero outside a passband to improve a rectangle coefficient of the filter. However, when implementing the low-end transmission zero, a blind hole with a certain depth is often used, which may imperceptibly increase the parasitic coupling of the filter, thus directly affecting an electrical performance of the filter.

SUMMARY OF THE INVENTION

The present invention aims to overcome the defects of the above technology, and provides a dielectric waveguide filter capable of effectively suppressing parasitic coupling.

The present invention provides a dielectric waveguide filter, comprising a dielectric substrate, the dielectric substrate comprises a plurality of resonators, and the plurality of resonators are connected to each other, wherein the dielectric substrate further comprises a negative coupling blind hole, the negative coupling blind hole is arranged at a joint between two adjacent resonators, the two adjacent resonators are respectively provided with a tuning blind hole, and the tuning blind hole of one of the two adjacent resonators is connected to the negative coupling blind hole by a first coupling structure.

Further, an outer surface of each resonator, inner surfaces of all the tuning blind holes and an inner surface of the negative coupling blind hole are all provided with a first conductive shielding layer.

Further, the tuning blind hole of the other one of the two adjacent resonators is connected to the negative coupling blind hole through a second coupling structure.

Further, upper surfaces of the two adjacent resonators are respectively provided with the tuning blind hole, the negative coupling blind hole is arranged at the joint between the upper surfaces of the two adjacent resonators, the first coupling structure is a first reinforcing ridge, the second coupling structure is a second reinforcing ridge, the first reinforcing ridge is arranged on the upper surface of the resonator on which the tuning blind hole connected to the first reinforcing ridge is located, and the second reinforcing ridge is arranged on the upper surface of the resonator on which the tuning blind hole connected to the second reinforcing ridge is located.

Further, a width of the first reinforcing ridge is equal or unequal to that of the second reinforcing ridge.

Further, a depth of the first reinforcing ridge is equal or unequal to that of the second reinforcing ridge.

Further, in the first reinforcing ridge and the second reinforcing ridge, a surface of at least one groove is provided with a second conductive shielding layer.

Further, upper surfaces of the two adjacent resonators are respectively provided with the tuning blind hole, the negative coupling blind hole is arranged at the joint between the upper surfaces of the two adjacent resonators, the first coupling structure is a first reinforcing ridge, and the first reinforcing ridge is arranged on the upper surface of the resonator on which the tuning blind hole connected to the first reinforcing ridge is located.

Further, a bottom portion of the first reinforcing ridge is provided with a through hole, and one end of the through hole far away from the first reinforcing ridge extends to a lower surface of the resonator on which the first reinforcing ridge is located; and an outer surface of each resonator is provided with a first conductive shielding layer, an inner surface of the first reinforcing ridge is provided with a second conductive shielding layer, an inner surface of the through hole is provided with a third conductive shielding layer, and the third conductive shielding layer of the through hole is respectively connected to the first conductive shielding layer of the corresponding resonator and the second conductive shielding layer of the first reinforcing ridge.

Further, a bottom portion of the first reinforcing ridge is provided with a through hole, and one end of the through hole far away from the first reinforcing ridge extends to a lower surface of the resonator on which the first reinforcing ridge is located; and an outer surface of each resonator is provided with a first conductive shielding layer, an inner surface of the through hole is provided with a third conductive shielding layer, and the third conductive shielding layer of the through hole is connected to or not connected to the first conductive shielding layer of the corresponding resonator.

According to the present invention, by arranging the first coupling structure, parasitic coupling generated between the two adjacent resonators may be effectively suppressed, so that an electrical performance of the dielectric waveguide filter may be ensured, thus being simple to process and easy to implement.

DETAILED DESCRIPTION

The present invention is further described hereinafter with reference to the accompanying drawings and the embodiments.

First Embodiment

Figure 1:
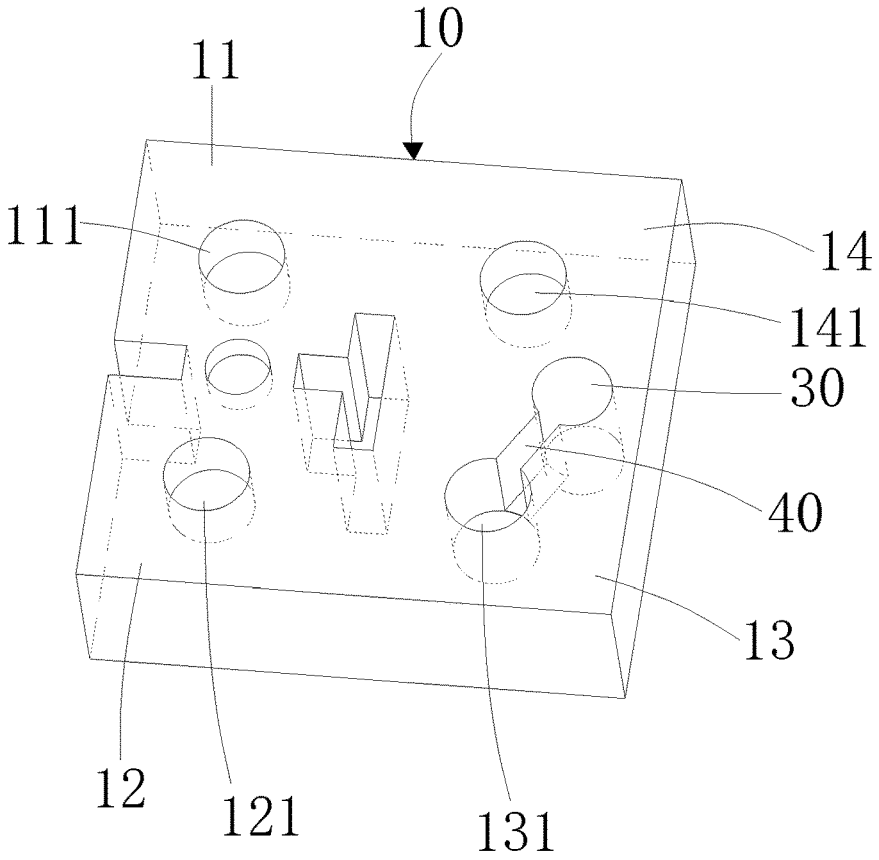
FIG. 1 is a schematic diagram of a structure of a dielectric waveguide filter provided by a first embodiment of the present invention.
Figure 2:
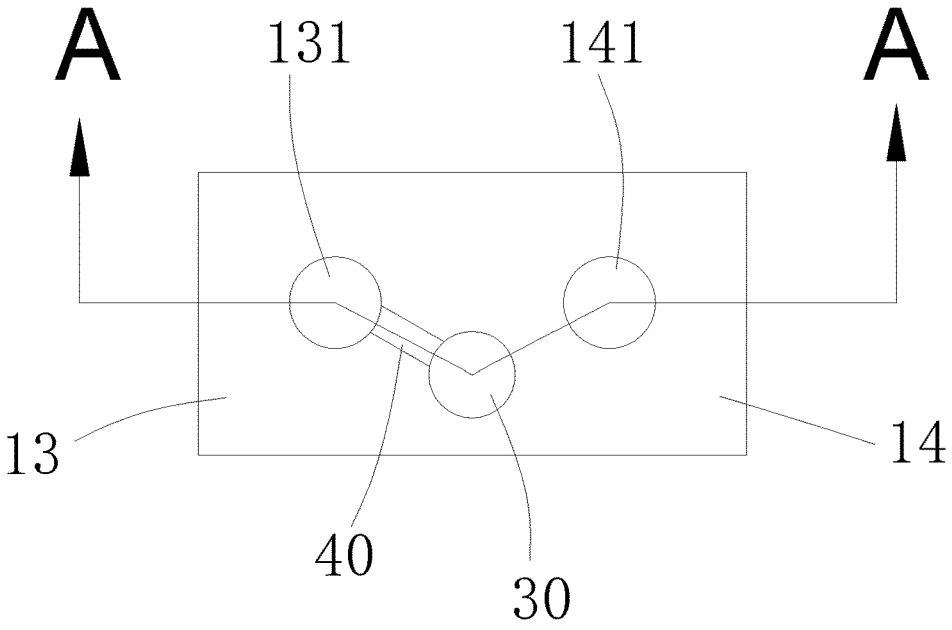
FIG. 2 is a top view of two resonators, a negative coupling blind hole and a first coupling structure of the dielectric waveguide filter shown in FIG. 1.

With reference to FIG. 1 and FIG. 2, the present invention provides a dielectric waveguide filter, comprising a dielectric substrate 10 made of a material with a high dielectric constant such as ceramic. The dielectric substrate 10 comprises a plurality of resonators, and the plurality of resonators are connected to each other. The plurality of resonators are distributed in a single layer or stacked layers, such as double layers, four layers and so on. In the embodiment, the dielectric substrate 10 comprises four resonators 11, 12, 13 and 14, the four resonators 11, 12, 13 and 14 are distributed in a single layer, and the four resonators 11, 12, 13 and 14 are connected to each other to form a square dielectric substrate 10 or dielectric substrates 10 of other shapes. Understandably, for example, two, three, five, six or more resonators may also be provided, and a number of the resonators may be set according to actual conditions.

Two adjacent resonators 13 and 14 are respectively provided with tuning blind holes 131 and 141. Understandably, the resonator 11 is also provided with a tuning blind hole 111, and the resonator 12 is also provided with a tuning blind hole 121. Certainly, the resonators 11 and 12 may not be provided with the tuning blind holes 111 and 121. The tuning blind hole is used for adjusting a resonant frequency of the resonator, and by adjusting a depth and a diameter of the tuning blind hole, the resonant frequency may be adjusted. The tuning blind hole is generally arranged at a center position of the corresponding resonator. Depths of the tuning blind holes of all resonators may be equal or unequal, and diameters of the tuning blind holes of all resonators may be equal or unequal.

The dielectric substrate 10 further comprises a negative coupling blind hole 30, the negative coupling blind hole 30 is arranged at a joint between two adjacent resonators 13 and 14, and the negative coupling blind hole 30 is connected to the tuning blind hole 131 of the resonator 13 from the two adjacent resonators 13 and 14 by a first coupling structure. A depth of the negative coupling blind hole 30 is generally set to be greater than those of the tuning blind holes 131 and 141. The negative coupling blind hole 30 is used for implementing capacitive coupling between the two adjacent resonators 13 and 14, so that the dielectric waveguide filter may generate a transmission zero at a low end of a passband, thus improving out-of-band suppression. Due to the existence of the negative coupling blind hole 30, and a position, a size, a shape and other factors of a coupling window for coupling energy between the adjacent resonators, parasitic coupling may occur between the two adjacent resonators 13 and 14. However, by arranging the first coupling structure, parasitic coupling generated between the two adjacent resonators 13 and 14 may be effectively suppressed, so that an electrical performance of the dielectric waveguide filter may be ensured, thus being simple to process and easy to implement.

In the embodiment, upper surfaces of the resonators 13, 14, 11 and 12 are respectively provided with the tuning blind holes 131, 141, 111 and 121. The negative coupling blind hole 30 is arranged at the joint between the upper surfaces of the two adjacent resonators 13 and 14. The upper surfaces of the four resonators 11, 12, 13 and 14 constitute an upper surface of the dielectric substrate 10, and lower surfaces of the four resonators 11, 12, 13 and 14 constitute a lower surface of the dielectric substrate 10. The first coupling structure is a first reinforcing ridge 40, the first reinforcing ridge 40 is of a groove structure, and the first reinforcing ridge 40 is arranged on the upper surface of the resonator 13 on which the tuning blind hole 131 connected to the first reinforcing ridge is located. The first reinforcing ridge 40 is respectively communicated with the negative coupling blind hole 30 and the corresponding tuning blind hole 131.

A cross-section shape of the first reinforcing ridge 40 is rectangular or elliptical, and a cross-section shape of the first reinforcing ridge 40 does not constitute a limitation to the present invention.

A depth of the first reinforcing ridge 40 is smaller than that of the negative coupling blind hole 30. Understandably, the depth of the first reinforcing ridge 40 may be equal to that of the negative coupling blind hole 30. By adjusting the depth of the first reinforcing ridge 40, a parasitic coupling coefficient between the two resonators 13 and 14 may be adjusted.

Figure 3:
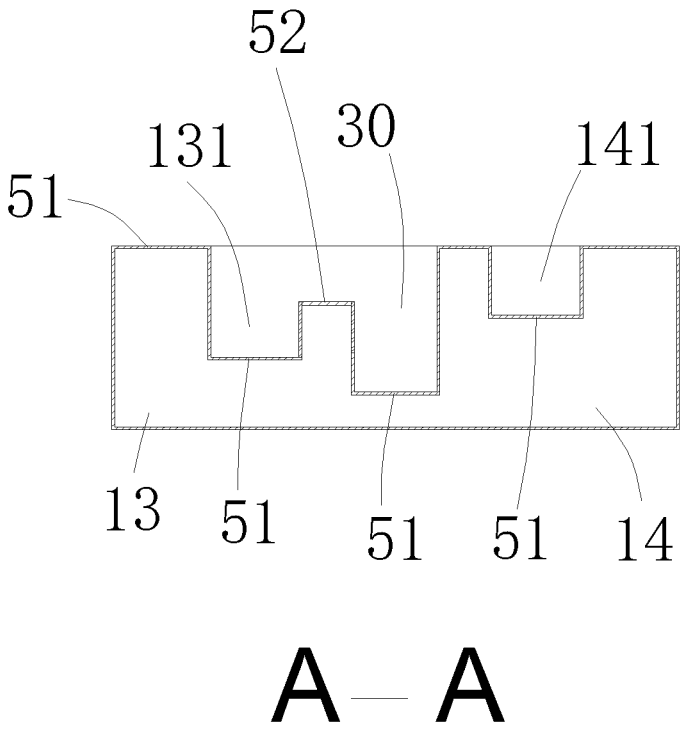
FIG. 3 is a cross-section view of a first solution of an A-A part shown in FIG. 2.

With reference to FIG. 3, an outer surface of each resonator and an inner surface (which is namely an inner wall and a bottom surface) of the negative coupling blind hole 30 are both provided with a first conductive shielding layer 51. An inner surface (an inner wall and a bottom surface) of the first reinforcing ridge 40 is provided with a second conductive shielding layer 52. First conductive shielding layers 51 on inner surfaces of all tuning blind holes and the first conductive shielding layer 51 on the inner surface of the negative coupling blind hole 30 are all connected to the first conductive shielding layers 51 on the upper surfaces of the corresponding resonators. The second conductive shielding layer 52 on the inner surface of the first reinforcing ridge 40 is connected to the first conductive shielding layer 51 on the upper surface of the resonator 13 on which the first reinforcing ridge 40 is located, the first conductive shielding layer 51 on the inner wall of the negative coupling blind hole 30, and the first conductive shielding layer 51 on the inner wall of the corresponding tuning blind hole 131. The second conductive shielding layer 52 is made of the same material as the first conductive shielding layer 51, such as silver, copper and other metal materials, which may be arranged on a corresponding surface by electroplating, coating and other technologies. Understandably, the second conductive shielding layer 52 may also be made of the different material from the first conductive shielding layer 51, which may be set according to actual conditions.

Figure 4:
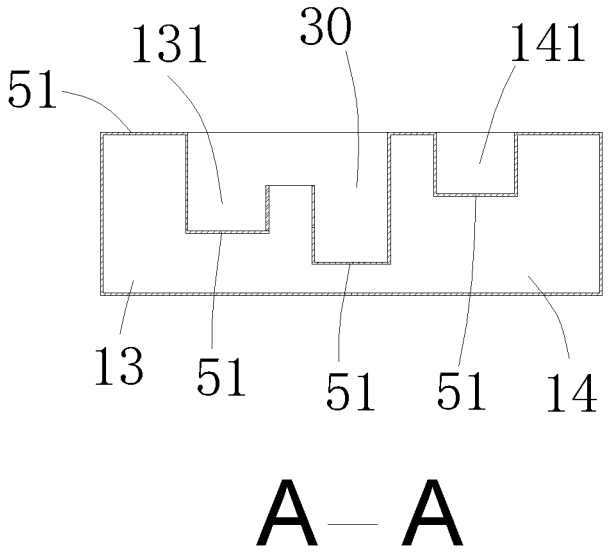
FIG. 4 is a cross-section view of a second solution of the A-A part shown in FIG. 2.

With reference to FIG. 4, understandably, in an alternative solution, the inner surface (the inner wall and the bottom surface) of the first reinforcing ridge 40 may not be provided with the second conductive shielding layer 52.

Second Embodiment

Figure 5:
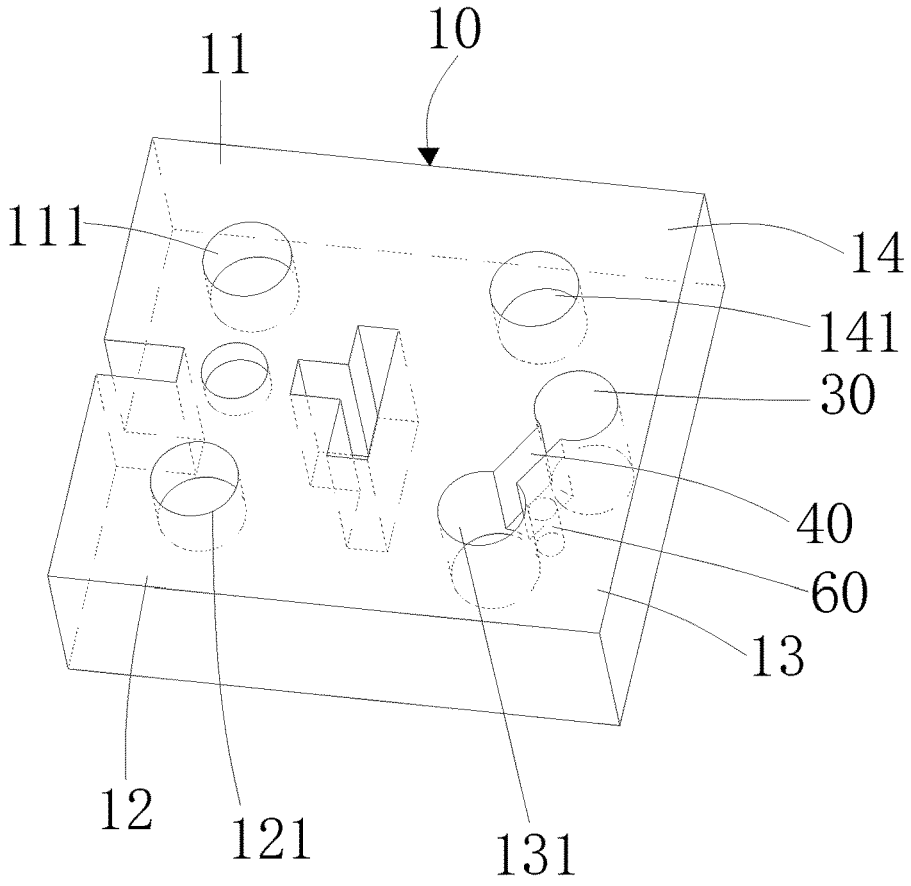
FIG. 5 is a schematic diagram of a structure of a dielectric waveguide filter provided by a second embodiment of the present invention.
Figure 6:
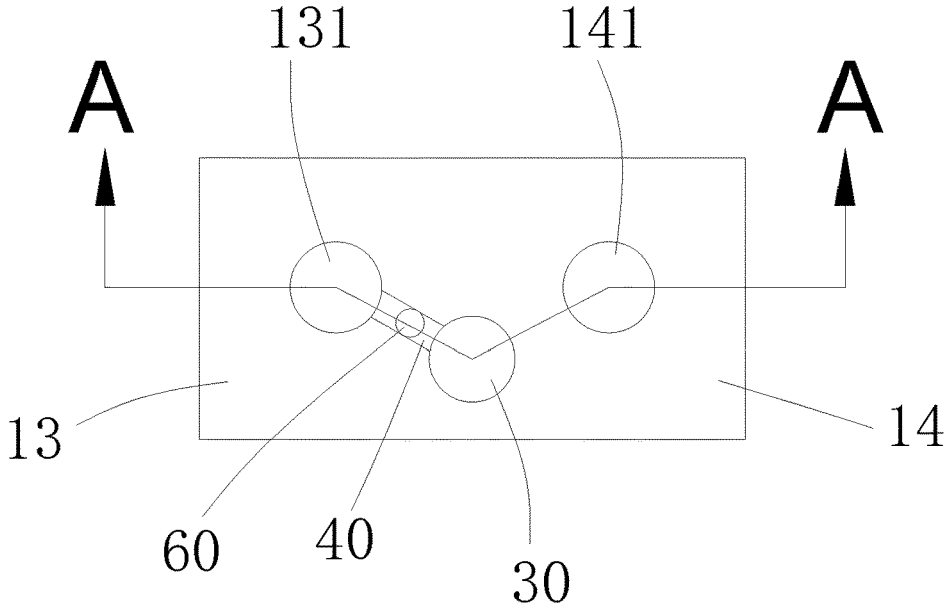
FIG. 6 is a top view of two resonators, a negative coupling blind hole and a first coupling structure of the dielectric waveguide filter shown in FIG. 5.

With reference to FIG. 5 and FIG. 6, the embodiment is different from the first embodiment in that a bottom portion of the first reinforcing ridge 40 is provided with a through hole 60, and one end of the through hole 60 far away from the first reinforcing ridge 40 extends to a lower surface of the resonator 13 on which the first reinforcing ridge 40 is located. The arrangement of the through hole 60 can reduce a difficulty of forming the dielectric substrate 10, and can reduce a possibility of deforming the dielectric substrate 10. In the embodiment, the through hole 60 is a round hole, and the round hole is coaxial or non-coaxial with the first reinforcing ridge 40. An inner diameter of the round hole is smaller than or equal to a width of the first reinforcing ridge 40. A depth of the round hole is smaller than a depth of the first reinforcing ridge 40.

Figure 7:
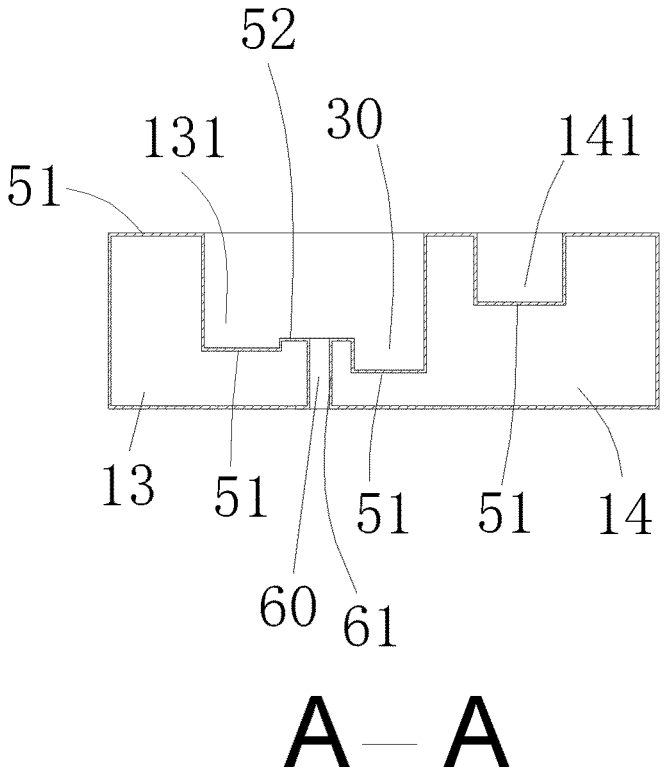
FIG. 7 is a cross-section view of a first solution of an A-A part shown in FIG. 6.

With reference to FIG. 7, the outer surface of each resonator, the inner surfaces (the inner walls and the bottom surfaces) of all tuning blind holes, and the inner surface (which is namely the inner wall and the bottom surface) of the negative coupling blind hole 30 are all provided with the first conductive shielding layer 51. The inner surface (the inner wall and the bottom surface) of the first reinforcing ridge 40 is provided with the second conductive shielding layer 52. The first conductive shielding layers 51 on the inner surfaces of all tuning blind holes and the first conductive shielding layer 51 on the inner surface of the negative coupling blind hole 30 are all connected to the first conductive shielding layers 51 on the upper surfaces of the corresponding resonators. The second conductive shielding layer 52 on the inner surface of the first reinforcing ridge 40 is connected to the first conductive shielding layer 51 on the upper surface of the resonator 13 on which the first reinforcing ridge 40 is located, the first conductive shielding layer 51 on the inner wall of the negative coupling blind hole 30, and the first conductive shielding layer 51 on the inner wall of the corresponding tuning blind hole 131. The second conductive shielding layer 52 is made of the same material as the first conductive shielding layer 51, such as silver, copper and other metal materials, which may be arranged on a corresponding surface by electroplating, coating and other technologies. The second conductive shielding layer 52 may also be made of the different material from the first conductive shielding layer 51.

An inner surface (which is namely an inner wall) of the through hole 60 is provided with a third conductive shielding layer 61. The third conductive shielding layer 61 on the inner surface (which is namely the inner wall) of the through hole 60 is respectively connected to the second conductive shielding layer 52 on the bottom surface of the first reinforcing ridge 40 and the first conductive shielding layer 51 on the lower surface of the corresponding resonator 13. The third conductive shielding layer 61 is made of the same material as or the different material from the first conductive shielding layer 51 and the second conductive shielding layer 52.

Figure 8:
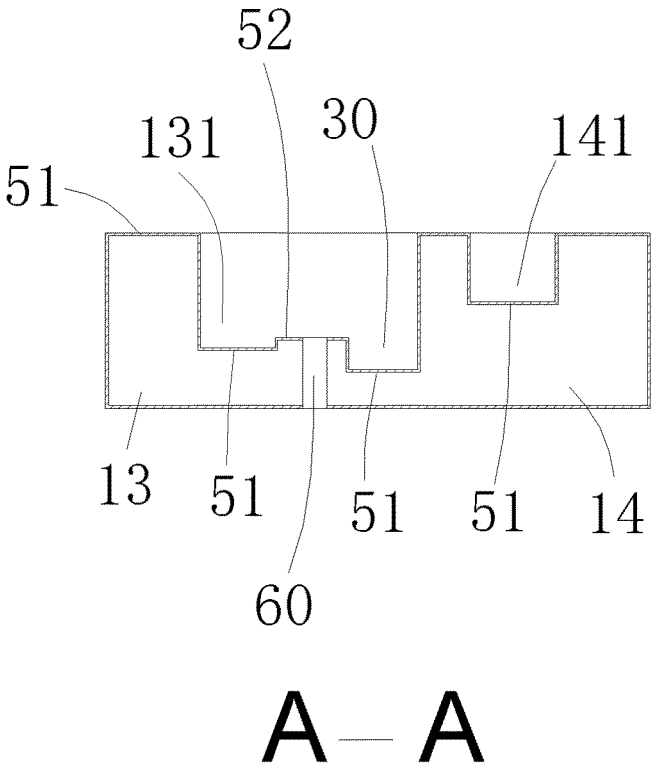
FIG. 8 is a cross-section view of a second solution of the A-A part shown in FIG. 6.

With reference to FIG. 8, understandably, in a first alternative solution, the inner surface (which is namely the inner wall) of the through hole 60 may not be provided with the third conductive shielding layer 61.

Figure 9:
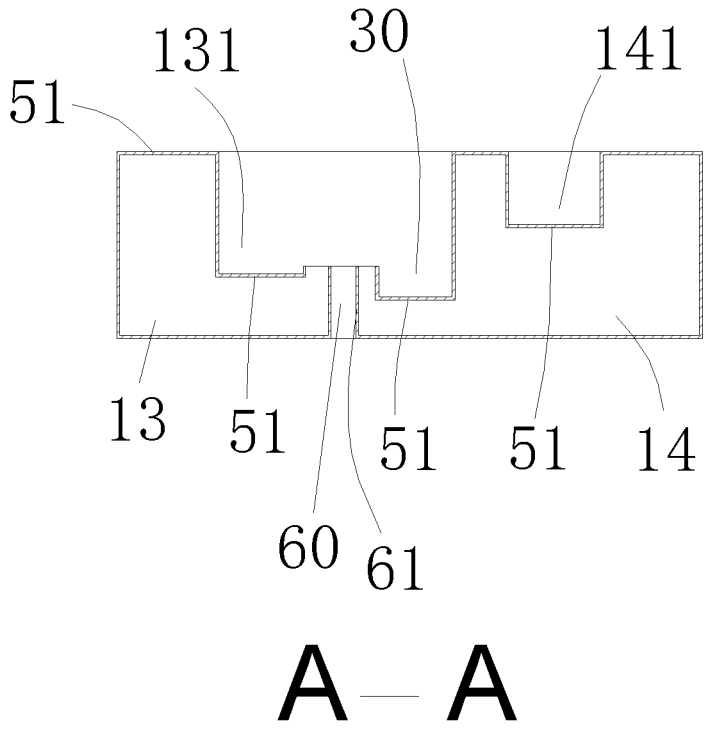
FIG. 9 is a cross-section view of a third solution of the A-A part shown in FIG. 6.

With reference to FIG. 9, in a second alternative solution, the outer surface of each resonator, the inner surfaces (the inner walls and the bottom surfaces) of all tuning blind holes, and the inner surface (which is namely the inner wall and the bottom surface) of the negative coupling blind hole 30 are all provided with the first conductive shielding layer 51. The inner surface (the inner wall and the bottom surface) of the first reinforcing ridge 40 is not provided with the second conductive shielding layer 52. The third conductive shielding layer 61 on the inner surface (which is namely the inner wall) of the through hole 60 is only connected to the first conductive shielding layer 51 on the lower surface of the corresponding resonator 13.

Figure 10:
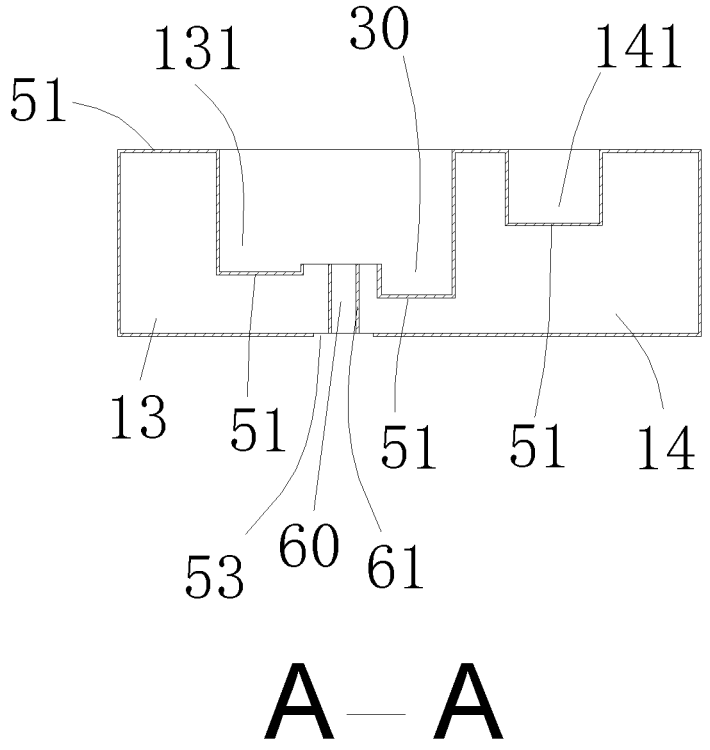
FIG. 10 is a cross-section view of a fourth solution of the A-A part shown in FIG. 6.

With reference to FIG. 10, in a third alternative solution, the outer surface of each resonator, the inner surfaces (the inner walls and the bottom surfaces) of all tuning blind holes, and the inner surface (which is namely the inner wall and the bottom surface) of the negative coupling blind hole 30 are all provided with the first conductive shielding layer 51. The inner surface (the inner wall and the bottom surface) of the first reinforcing ridge 40 is not provided with the second conductive shielding layer 52. The first conductive shielding layer 51 on the lower surface of the resonator 13 on which the through hole 60 is located is formed with an isolation region 53, the isolation region 53 is arranged around the through hole 60, and the isolation region 53 is used for isolating the third conductive shielding layer 61 on the inner surface (which is namely the inner wall) of the through hole 60 from the first conductive shielding layer 51 on the lower surface of the corresponding resonator 13. The isolation region 53 is of an annular structure. The isolation region 53 is formed by removing a part of the first conductive shielding layer 51 located around the through hole 60 by laser processing, polishing, or other technologies. By adjusting an area of the isolation region 53, a parasitic coupling coefficient of the dielectric waveguide filter may be adjusted.

Third Embodiment

Figure 11:
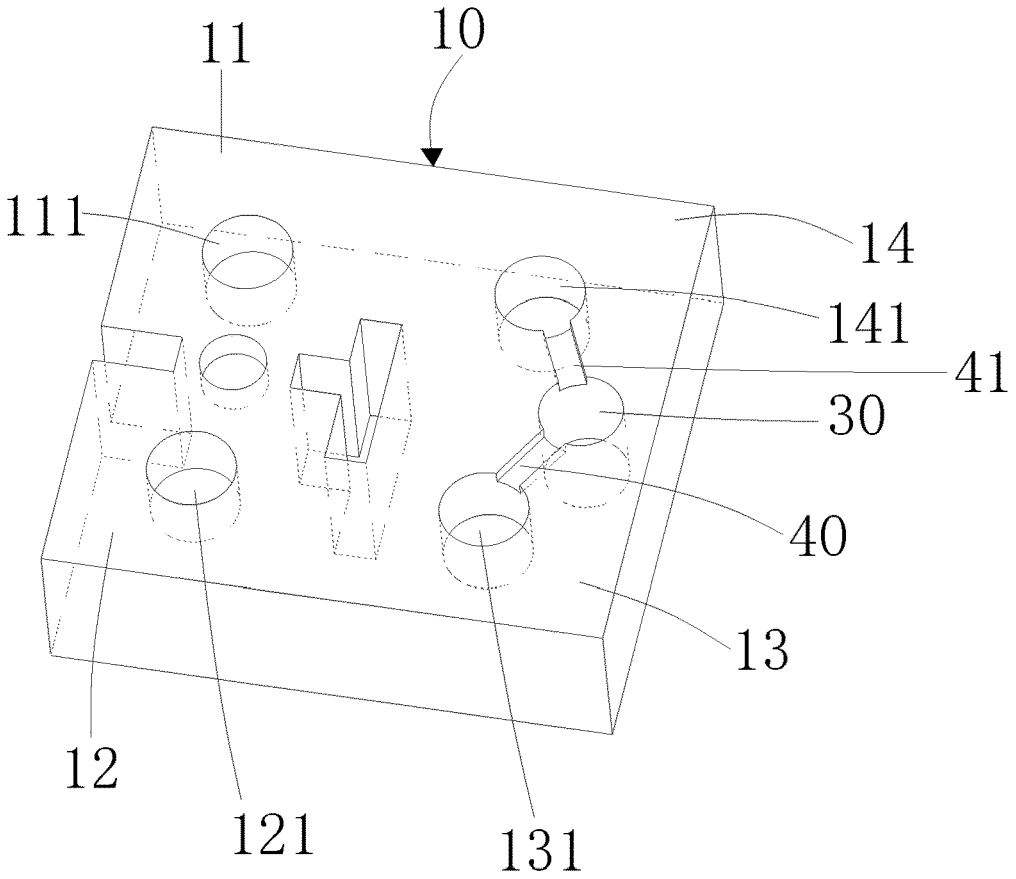
FIG. 11 is a schematic diagram of a structure of a dielectric waveguide filter provided by a third embodiment of the present invention.
Figure 12:
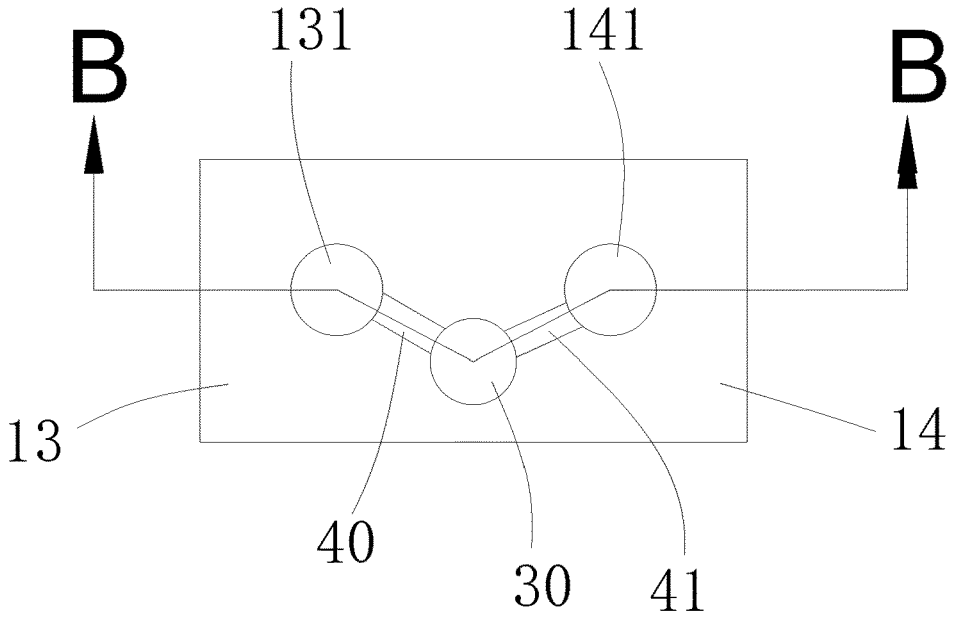
FIG. 12 is a top view of two resonators, a negative coupling blind hole and a first coupling structure of the dielectric waveguide filter shown in FIG. 11.

With reference to FIG. 11 and FIG. 12, the embodiment is different from the first embodiment in that the negative coupling blind hole 30 is connected to the tuning blind hole 141 of the resonator 14 from the two adjacent resonators 13 and 14 through the second coupling structure. The second coupling structure arranged may further effectively suppress parasitic coupling generated between the two adjacent resonators 13 and 14, so that an electrical performance of the dielectric waveguide filter may be further ensured.

The second coupling structure is a second reinforcing ridge 41, the first reinforcing ridge 40 is arranged on the upper surface of the resonator 13 on which the tuning blind hole 131 connected to the first reinforcing ridge is located, and the second reinforcing ridge 41 is arranged on the upper surface of the resonator 14 on which the tuning blind hole 141 connected to the second reinforcing ridge is located. The second reinforcing ridge 41 is of a groove structure. The second reinforcing ridge 41 is mutually communicated with the negative coupling blind hole 30 and the corresponding tuning blind hole 141.

A cross-section shape of the second reinforcing ridge 41 is the same as that of the first reinforcing ridge 40, such as being rectangular or elliptic. A width and a depth of the second reinforcing ridge 41 are equal to those of the first reinforcing ridge 40. Understandably, the width and the depth of the second reinforcing ridge 41 may also be unequal to those of the first reinforcing ridge 40.

Figure 13:
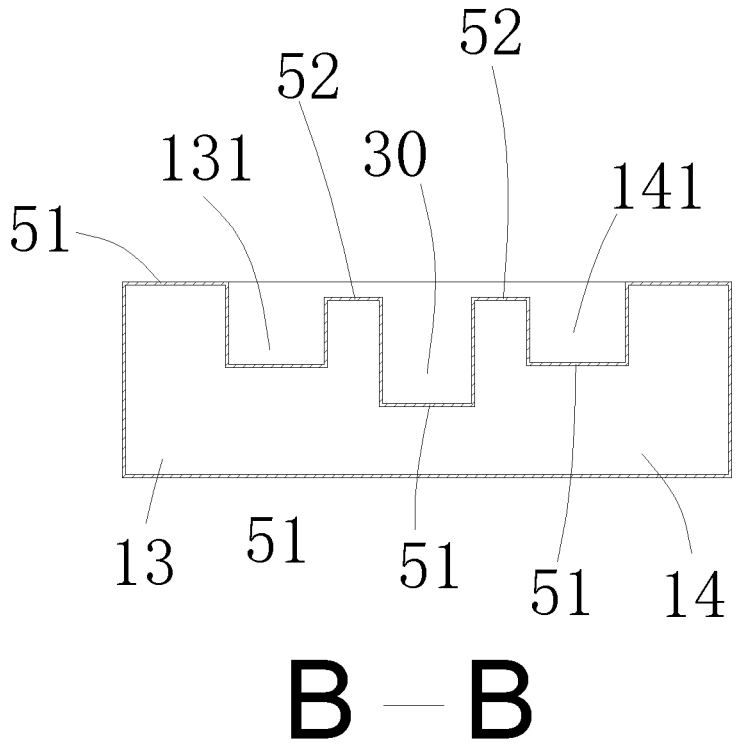
FIG. 13 is a cross-section view of a first solution of a B-B part shown in FIG. 12.

With reference to FIG. 13, the outer surface of each resonator, the inner surfaces (which are namely the inner walls and the bottom surfaces) of all tuning blind holes, and the inner surface (which is namely the inner wall and the bottom surface) of the negative coupling blind hole 30 are all provided with the first conductive shielding layer 51. The inner surface (the inner wall and the bottom surface) of the first reinforcing ridge 40 and an inner surface (which is namely an inner wall and a bottom surface) of the second reinforcing ridge 41 are provided with the second conductive shielding layer 52. The second conductive shielding layer 52 on the inner surface (which is namely the inner wall and the bottom surface) of the first reinforcing ridge 40 and the second conductive shielding layer 52 on the inner surface (which is namely the inner wall and the bottom surface) of the second reinforcing ridge 41 are respectively connected to the first conductive shielding layer 51 on the upper surface of the resonator 14 on which the second reinforcing ridge 41 is located, the first conductive shielding layer 51 on the inner wall of the negative coupling blind hole 30, and the first conductive shielding layer 51 on the inner wall of the corresponding tuning blind hole. The second conductive shielding layer 52 is name of the same material as the first conductive shielding layer 51. Understandably, the second conductive shielding layer 52 may also be made of the different material from the first conductive shielding layer 51.

In other embodiments, the conductive shielding layer arranged on the inner surface (which is namely the inner wall and the bottom surface) of the first reinforcing ridge 40 may be made of the different material from the conductive shielding layer arranged on the inner surface (which is namely the inner wall and the bottom surface) of the second reinforcing ridge 41.

Figure 14:
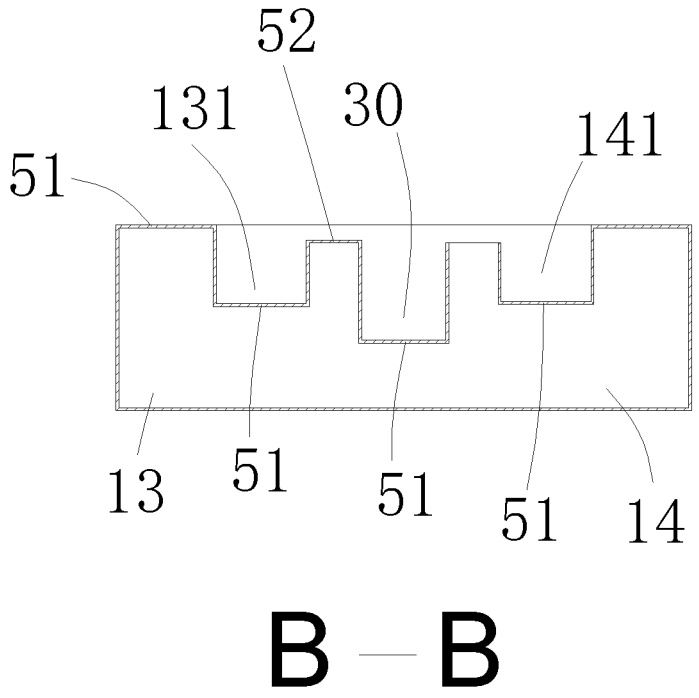
FIG. 14 is a cross-section view of a second solution of the B-B part shown in FIG. 12.

With reference to FIG. 14, in an alternative solution, the outer surface of each resonator, the inner surfaces (which are namely the inner walls and the bottom surfaces) of all tuning blind holes, and the inner surface (which is namely the inner wall and the bottom surface) of the negative coupling blind hole 30 are all provided with the first conductive shielding layer 51. The bottom surface of the first reinforcing ridge 40 is provided with the second conductive shielding layer 52, and the inner surface (which is namely the inner wall and the bottom surface) of the second reinforcing ridge 41 is not provided with the second conductive shielding layer 52.

Figure 15:
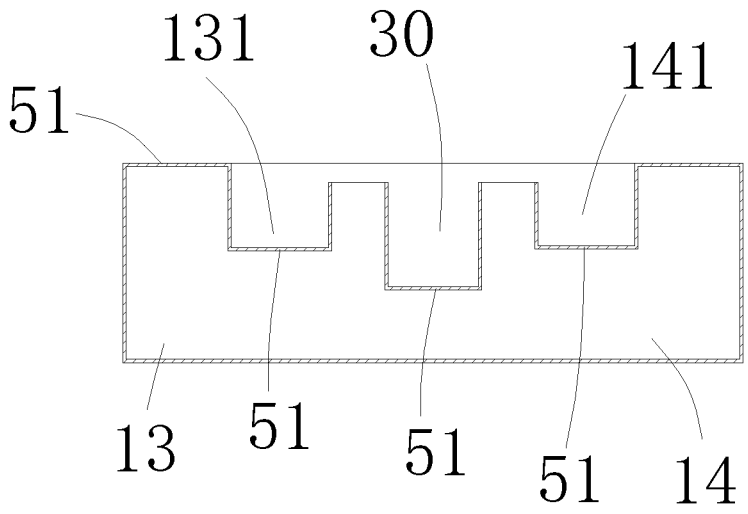
FIG. 15 is a cross-section view of a third solution of the B-B part shown in FIG. 12.

With reference to FIG. 15, in another alternative solution, the outer surface of each resonator, the inner surfaces (which are namely the inner walls and the bottom surfaces) of all tuning blind holes, and the inner surface (which is namely the inner wall and the bottom surface) of the negative coupling blind hole 30 are all provided with the first conductive shielding layer 51. The bottom surface of the first reinforcing ridge 40 and the inner surface (which is namely the inner wall and the bottom surface) of the second reinforcing ridge 41 are not provided with the second conductive shielding layer 52.

The above embodiments only express the preferred embodiments of the present invention, and the descriptions are specific and detailed, but they cannot be understood as limiting the scope of the patent of the present invention. It shall be noted that those of ordinary skills in the art may further make several modifications and improvements without departing from the concept of the present invention, such as combining different features in various embodiments, and these modifications and improvements all fall within the scope of protection of the present invention.

The invention claimed is:

1. A dielectric waveguide filter, comprising a dielectric substrate, the dielectric substrate comprising a plurality of resonators, and the plurality of resonators being connected to each other, wherein the dielectric substrate further comprises a negative coupling blind hole, the negative coupling blind hole being arranged at a joint between two adjacent resonators, the two adjacent resonators being respectively provided with a tuning blind hole, the tuning blind hole of one of the two adjacent resonators being connected to the negative coupling blind hole by a first coupling structure.

2. The dielectric waveguide filter according to claim 1, wherein the outer surface of each resonator, the inner surfaces of all the tuning blind holes and the inner surface of the negative coupling blind hole are all provided with a first conductive shielding layer.

3. The dielectric waveguide filter according to claim 1, wherein the tuning blind hole of the other one of the two adjacent resonators is connected to the negative coupling blind hole through a second coupling structure.

4. The dielectric waveguide filter according to claim 3, wherein upper surfaces of the two adjacent resonators are respectively provided with the tuning blind hole, the negative coupling blind hole being arranged at the joint between the upper surfaces of the two adjacent resonators, the first coupling structure being a first reinforcing ridge, the second coupling structure being a second reinforcing ridge, the first reinforcing ridge being arranged on the upper surface of the resonator on which the tuning blind hole connected to the first reinforcing ridge is located, and the second reinforcing ridge being arranged on the upper surface of the resonator on which the tuning blind hole connected to the second reinforcing ridge is located.

5. The dielectric waveguide filter according to claim 4, wherein a width of the first reinforcing ridge is equal or unequal to that of the second reinforcing ridge.

6. The dielectric waveguide filter according to claim 4, wherein a depth of the first reinforcing ridge is equal or unequal to that of the second reinforcing ridge.

7. The dielectric waveguide filter according to claim 4, wherein in the first reinforcing ridge and the second reinforcing ridge, a surface of at least one groove is provided with a second conductive shielding layer.

8. The dielectric waveguide filter according to claim 1, wherein upper surfaces of the two adjacent resonators are respectively provided with the tuning blind hole, the negative coupling blind hole being arranged at the joint between the upper surfaces of the two adjacent resonators, the first coupling structure being a first reinforcing ridge, and the first reinforcing ridge being arranged on the upper surface of the resonator on which the tuning blind hole connected to the first reinforcing ridge is located.

9. The dielectric waveguide filter according to claim 8, wherein a bottom portion of the first reinforcing ridge is provided with a through hole, and one end of the through hole far away from the first reinforcing ridge extends to a lower surface of the resonator on which the first reinforcing ridge is located; and an outer surface of each resonator is provided with a first conductive shielding layer, an inner surface of the first reinforcing ridge being provided with a second conductive shielding layer, an inner surface of the through hole being provided with a third conductive shielding layer, and the third conductive shielding layer of the through hole being respectively connected to the first conductive shielding layer of the corresponding resonator and the second conductive shielding layer of the first reinforcing ridge.

10. The dielectric waveguide filter according to claim 8, wherein a bottom portion of the first reinforcing ridge is provided with a through hole, and one end of the through hole far away from the first reinforcing ridge extends to a lower surface of the resonator on which the first reinforcing ridge is located; and an outer surface of each resonator being provided with a first conductive shielding layer, an inner surface of the through hole being provided with a third conductive shielding layer, and the third conductive shielding layer of the through hole being connected to or not connected to the first conductive shielding layer of the corresponding resonator.

* * * * *